United States Patent [19]

Arai

[11] Patent Number: 5,053,830

[45] Date of Patent: Oct. 1, 1991

[54] FIXING APPARATUS HAVING SHEET SEPARATOR PAWLS FOR IMAGE FORMING APPARATUS

[75] Inventor: Atsushi Arai, Ichikawa, Japan

[73] Assignee: Ricoh Company, Ltd., Tokyo, Japan

[21] Appl. No.: 443,494

[22] Filed: Nov. 30, 1989

[30] Foreign Application Priority Data

Nov. 30, 1988 [JP] Japan ..... 63-154860[U]
Nov. 30, 1988 [JP] Japan ..... 63-154861[U]
Jul. 12, 1989 [JP] Japan ..... 1-81184[U]

[51] Int. Cl.[5] ..... G03G 21/00

[52] U.S. Cl. ..... 355/290; 271/900; 271/307; 355/285; 355/315

[58] Field of Search ..... 355/315, 285, 282, 290, 355/289; 271/900, 307, 308, 312; 219/216

[56] References Cited

U.S. PATENT DOCUMENTS 4,065,120 12/1977 Imaizumi et al. ..... 432/60
4,252,310 2/1981 Kono et al. ..... 355/315 X
4,336,992 6/1982 Szlucha et al. ..... 355/285
4,748,473 5/1988 Tsuruoka ..... 355/315

FOREIGN PATENT DOCUMENTS 162769 12/1981 Japan ..... 355/315
200564 9/1986 Japan ..... 355/315
276076 11/1988 Japan ..... 355/285
040870 2/1989 Japan ..... 355/282
040871 2/1989 Japan ..... 355/285

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

A fixing apparatus installed in an image forming apparatus and having a pair of rollers engaged with each other for fusing and fixing toner images to a paper. Pivotable sheet separator pawls are resiliently engageable at their free ends with the periphery of one of the said rollers for separating from the periphery of the roller a leading end portion of the paper coming out of a nipping section of the rollers with the fixed toner images. The sheet separator pawls moves in parallel with the direction of axes of said rollers while said rollers stop.

9 Claims, 6 Drawing Sheets

FIXING APPARATUS HAVING SHEET SEPARATOR PAWLS FOR IMAGE FORMING APPARATUS

BACKGROUND OF THE INVENTION

The present invention relates to a fixing apparatus for use with an image forming apparatus.

A prior art fixing apparatus adapted for an image forming apparatus such as an electrophotographic copying apparatus, a facsimile apparatus and a laser printer usually includes a fixing roller which is provided with a rubber layer thereon and a heater thereinside and is pressed by a pressure roller. These rollers serve for permanently fixing toner images to a transfer sheet at the nipping position. In this type of fixing apparatus, a leading end portion of the sheet with the fixed toner images is apt to stick to the periphery of the fixing roller. Therefore, it has been customary to employ sheet separator pawls resiliently engageable at their free ends with the periphery of the fixing roller, for forcibly separating a leading end portion of the sheet from the periphery of the fixing roller.

A problem has existed in such a type of fixing apparatus in that an anti-offset layer made from an anti-offset material such as fluorine-contained polymers which is coated on the surface of the fixing roller is scraped by the free ends of the sheet separator pawls as the fixing roller rotates. Also, tubular metal shafts or sleeves have appeared. The result is that a sheet cannot be separated easily from the fixing roller and jamming of the sheet has happened. When it has happened, the fixing roller is thus judged to have run down and must be exchanged. As a life span of a fixing roller is mainly decided according to the flaws imparted on the periphery of the fixing roller by the sheet separator pawls, it is very important in order to get a high-reliability and a long span of life of the fixing roller for an electrophotographic copying machine or the like. how to reduce the damage to the surface of the anti-offset layer by the sheet separator pawls.

Some different approaches have been proposed to eliminate such an ocurrence. One approach is providing that the paper separator pawls go back and forth in the direction of an axis of the fixing roller and the movement of the pawls is synchronized with rotating of the fixing roller, which is disclosed by Japanese Laid-Open Patent Publication No. 52-39148. Another approach is proving that the paper separator pawls can be movable and be set in some predetermined positions by a person, which is disclosed by Japanese Laid-Open Patent Publication No. 62-1778. The position of the pawls are changed by the person when he observes the surface of the roller and judges that the roller should be changed because of damage thereto.

However, a problem with the device of the first approach is that the fixing roller cannot rotate at the correct speed because of the load of the moving pawls. As the pawls are leaning toward the moving direction and an engaging portion of the pawls pushes the surface of the fixing roller while the pawls moving, extra loads are loaded on the rotating roller. And as the fixing roller cannot rotate at the predetermined speed, the fixing condition is changed slightly. And a problem with the second approach is that it is difficult for people in general to judge the time when the fixing roller should be changed according to the flaws of the surface of the roller. Therefore, people tend to do nothing, with the result that the paper jams. And then they call a service person.

SUMMARY OF THE INVENTION

It is an object of the present invention to provide a fixing apparatus for a copying machine or the like which elimates the drawbacks particular to the prior art devices as discussed above, to get high-reliability and a long span of life of the fixing roller.

It is another object of the present invention to provide a fixing apparatus for a copying machine or the like which eliminates the flaws of the surface of the fixing roller.

It is another object of the present invention to provide a fixing apparatus for a copying machine or the like in which the sheet separator pawls can move to keep the fixing rollers in a good condition.

It is another object of the present invention to provide a fixing apparatus for a copying machine or the like in which the sheet separator pawls can move a minimum number of times.

In accordance with the present invention, a fixing apparatus is installed in a copying machine or the like and has a pair of rollers for fusing and fixing toner images on a paper in pressing contact with each other, pivotable sheet separator pawl means which are resiliently engaged with the periphery of the said roller at their free end for separating a leading end portion of an sheet coming out of a nipping section of the rollers from the periphery of the roller, and moving means to be controlled to make the sheet separator pawl means move parallel with axes of the above rollers while the rollers do not rotate and in response to a signal indicative of an operational condition of the image forming apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

While the fixing apparatus for a copying machine or the like of the present invention is susceptible of numerous physical embodiments, depending upon the environment and requirements of use, a substantial number of the herein shown and described embodiments have been made, tested and used, and all have performed in an eminently satisfactory manner.

Figure 1:
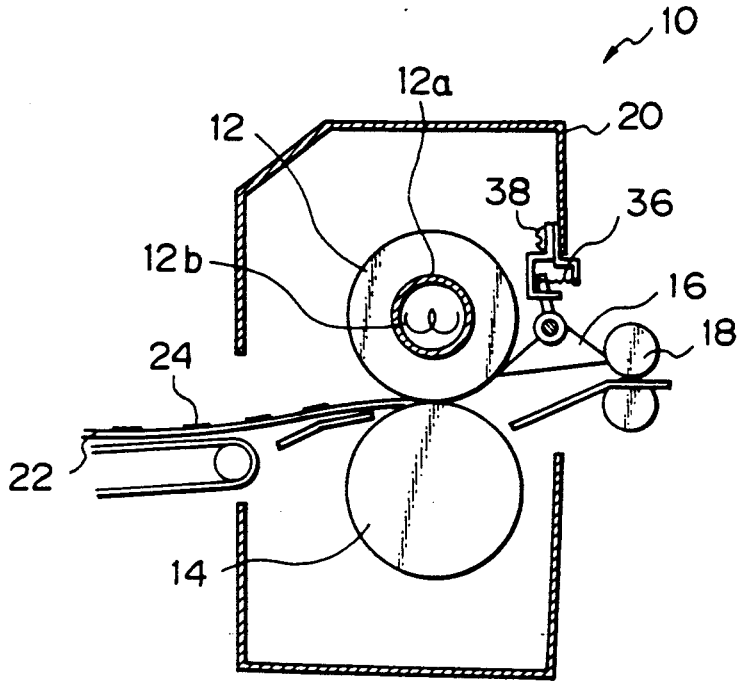
FIG. 1 is a sectional front view of a fixing apparatus embodying the present invention.

Referring to FIG. 1 of the drawings, the fixing apparatus generally designated by the reference numeral 10 comprises a fixing roller 12, a pressure roller 14, a sheet separator pawl 16, a pair of sheet feed rollers 18, a pair of side plates 20 for rotatably supporting the rollers, etc. A paper 22 carrying a toner image 24 therein is driven through a nipping section of the two rollers 12 and 14, whereby the toner image 24 is fused and fixed on the paper 22.

The fixing roller 12 includes a tubular metal shaft or sleeve 12*a* in which a heater 12*b* is positioned. A rubber layer covers the outer periphery of the sleeve 12*a*. An anti-offset layer made of silicon rubber or the like is deposited on the rubber layer.

Figure 2:
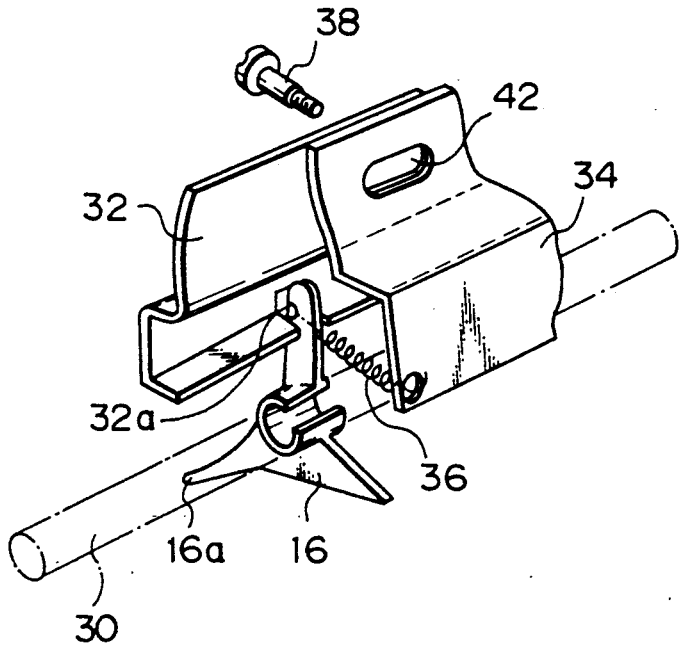
FIG. 2 is a perspective view of a slide mechanism for moving the sheet separator pawls.

Referring to FIG. 2, the sheet separator pawls 16 are individually pivotally and slidably mounted on the shaft 30. The pawls are loosely held by the recessed portion 32*a* of the slide plate 32. A holding plate 34 is fitted to the slide plate 32 so as to be substantially parallel to the plate 32. A tension spring 36 is anchored at one end of an arm 16*a* of the sheet separator pawl 16 and at the holding plate 34. The strength of the spring 36 is selected such that the end 16*a* of the sheet separator pawl 16 remains in light contact with the fixing roller 12. And such separator pawls 16 are arranged at a plurality of locations along the axis of the fixing roller 12. A shaft 30 extends substantially parallel with the axis of the fixing roller 12. The slide plate 32 and the holding plate 34 is mounted on the side plate 20 by the screw 38 which is inserted in oblong holes 40, 42 at the front and the back ens of the slide plate 32 and the holding plate 34, so that the slide plate 32 and the holding plate 34 can be slidable by a distance $\Delta 1$ in parallel with the axis of the fixing roller 12. A plunger 44*a* of a bi-directional moving solenoid 44 mounted on a housing of the machine is connected to the end plate 32*b* at the one end of the slide plate 32 (see FIG. 4A and 4B).

The above bi-directional moving solenoid 44 which is also called a self-holding type solenoid has a permanent magnet in addition to the magnetic circuit of the general DC solenoid. The plunger 44*a* is moved to one direction by an electro-magnet only when the current is set up for an instant, and it stays there by the permanent magnet without any current. And when the next current is set up for an instant, the plunger is moved to another direction by the electro-magnet. And the plunger 44*a* stays there by the permanent magnet without any current. No constant current is needed to have the plunger 44*a* stay at one position in the bi-directional moving solenoid 44. The detailed description of the bi-directional moving solenoid 44 is omitted in this discription because it is well-known.

Figure 3:
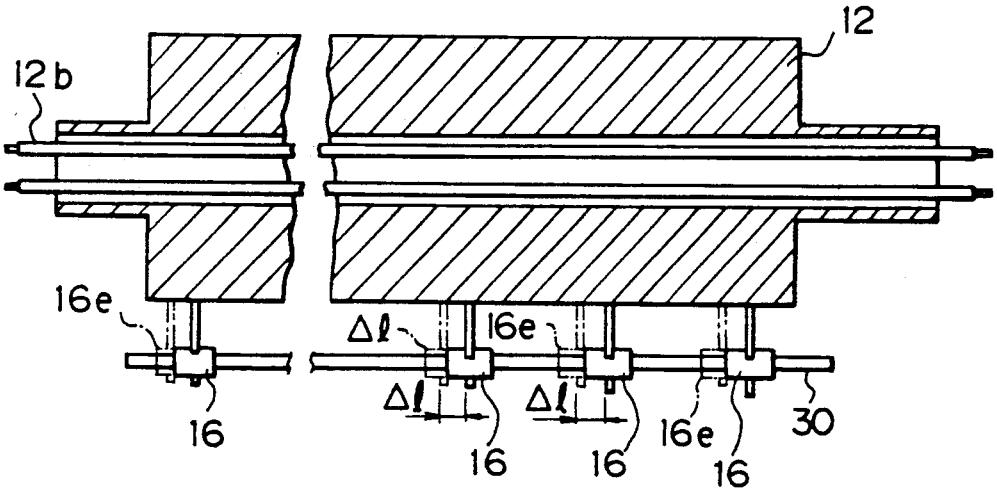
FIG. 3 is a sectional plan view of a fixing apparatus embodying the present invention.
Figure 4A:
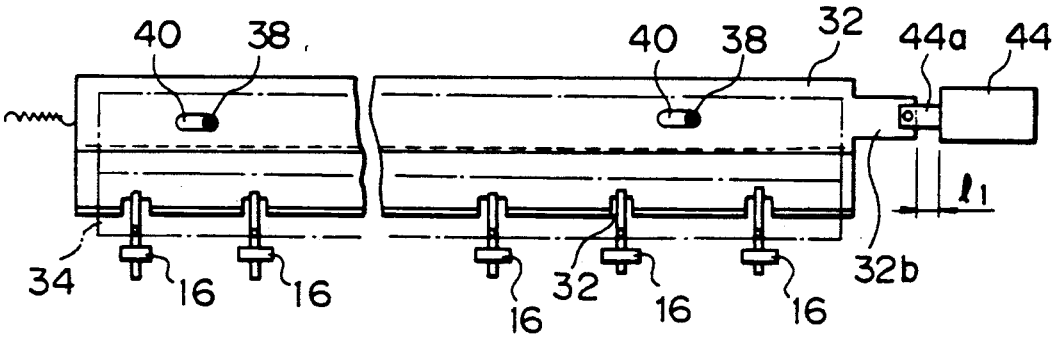
FIG. 4A and 4B are plans views of a slide mechanism for moving the sheet separator pawls.
Figure 4B:
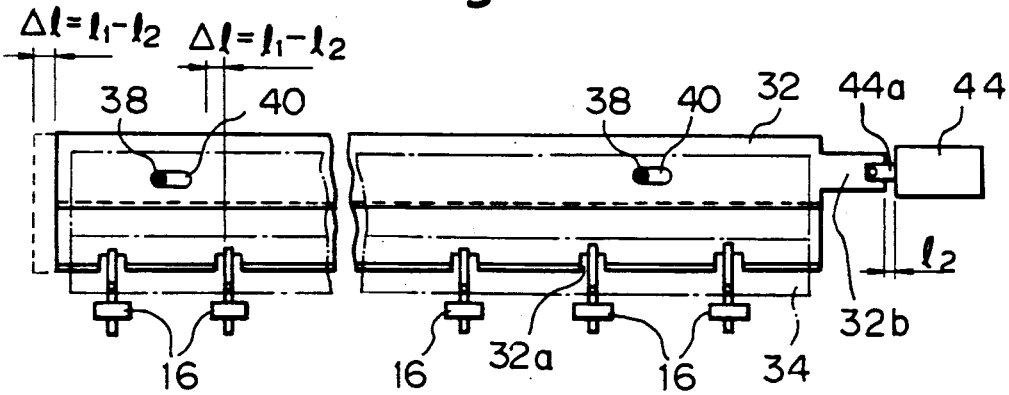

The slide plate 32 stops at two positions. FIG. 4A shows the first position of the slide plate 32 in which the plunger 44*a* extends from the solenoid body 44 at the distance $1_1$ between the end plate 32*b* and the solenoid body 44. And the screw 38 touches with the back end of the oblong holes 40,42(that is the right side end in the FIG. 4A). And FIG. 4B shows the second position of the slide plate 32 in which the plunger 44*a* extends from the solenoid body 44 at the distance $1_2$ between the end plate 32*b* and the solenoid body 44. And the screw 38 touches with the front end of the oblong holes 40,42(that is the left side end in the FIG. 4A). Therefore, every time the solenoid 44 is charged with electricity, the slide plate 32 goes forth or back at a distance $\Delta 1(=1_1-1_2)$ alternately. The sheet separator pawls 16 which are loosely held by the recessed portion 32*a* of the slide plate 32 move together with the slide plate 32 and take their stands at the two positions that are shown by solid lines 16*d* and chain lines 16*e* (see FIG. 3). The holding plate 34 in which the end of the spring 36 is anchored also moves together with slide plate 32 so that the sheet separator pawls 16 are not leaning, except in a pivotal direction when slide plate 32 stops. In the FIG. 2, FIG. 4A and FIG. 4B, the width of the recessed portion 32*a* is drawn bigger than the actual one with exaggeration so that it seems that the pawls can move freely in the width direction within the recessed portion 32*a*. But the width of the recessed portion 32*a* is actually only a little bigger than the width of the pawls 16 so that the pawls move together with the slide plate 32 at the same time.

The above electric charging to the solenoid 44 in order to move the sheet separator pawls 16 is controlled by a signal to be generated when the electric switching means which is indispensable to an electrophotographic copying machine or the like have been operated while the fixing roller does not rotate. The signals are indicative of an operational condition of the image forming apparatus, the following two conditions.

a) After the main swithc of the copier is turned on for the first time while the copier temperature is low such as in the morning and then a temperature of the fixing roller 12 is higher than a predetermined temperature to be able to melt the toner during a warm-up period of the fixing roller 12, the signal is generated.

b) After the copy starting button for starting copier turned on and while the fixing roller 12 does not rotate, the signal is generated. It may be just after the button has been turned on or just after the fixing roller has stopped.

Figure 5:
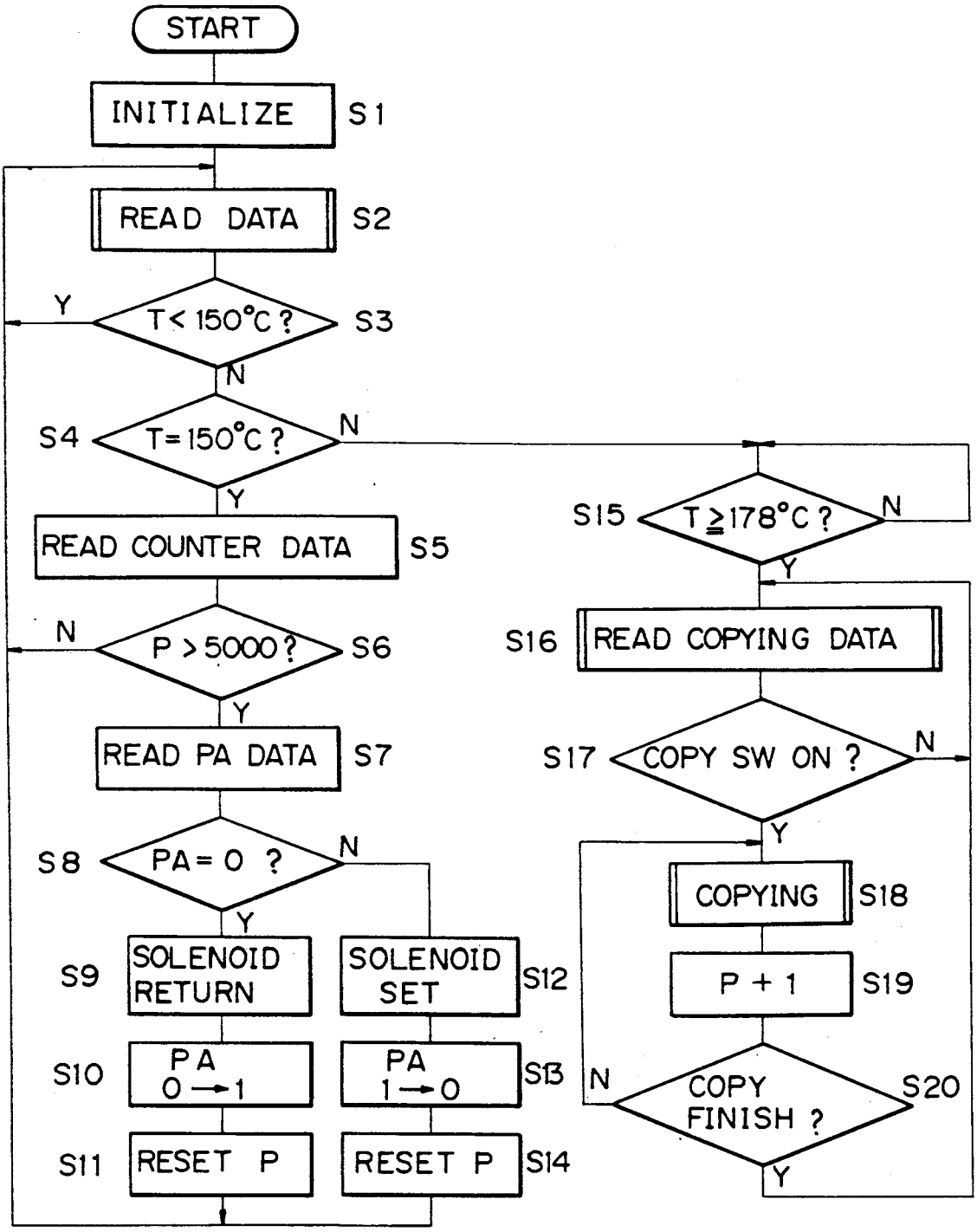
FIG. 5 is a flowchart according to an embodiment of the present invention.

FIG. 5 shows one example of the flowcharts demonstrating the said a)condition. As shown, when a main switch of the copier is turned on, a CPU of the controller for the copier is initialized(S1) and the data of signals from the copier is read, stored and made available(S2). And then a thermister senses the surface temperature T of the fixing roller. Whether the temperature T is the temperature to melt the toner, which is set at 150° C. in this example, or not is determined(S3). The program then waits until the temperature T becomes 150° C.(S3). If the sensed temperature T becomes 150° C.(S4), the data P which is a solenoid counter memorized in a permanent storage is read(S5). In a step S6 of FIG. 5, whether 5000 copies have been produced is determined. If the 5000 copies have been produced, a data of a PA memory in the permanent storage is read. And whether the PA memory is "0" or not is determined(S8). If the PA memory is "0", the bi-directional moving solenoid is returned(S9). Then the PA memory is incremented by "+1", that is, from "0" to "1"(S10) and the solenoid counter is cleared(S11). And if the PA memory is not "0" but "1", the bi-directional moving solenoid is set(S12). Then the PA memory is reset by "0", that is, from "1" to "0"(S13) and the solenoid counter is cleared(S14). According to this embodiment, whenever the sheet separator pawls move, the toner which will be stuck to the pawls is melt. The pawls move smoothly and the surface of the fixing roller is not to flawed easily because the toner which is stuck to the moving pawls has been melt. The temperature of the solenoid itself and the atmosphere around it is low degree when the solenoid is driven. Thus the driving means is not so much influenced by the heat of the fixing roller so that one can get a high-reliable driving means at a low cost.

As it is necessary only one or two times a day to turn on the main switch for the copier, the pawls don't move too many times. And the pawls move and change their position at regular intervals so that the flaws can be dispersed at two positions automatically and the life span of a fixing roller can be prolonged. And the pawls move only after the predetermined copies have been produced so that the solenoid is operated at a minimum load and the solenoid can work without breakdown for long time.

In the step S4 of FIG. 5, if the sensed temperature T is not 150° C.(S4), whether the sensed temperature T has arrived at fixing temperature which is set at 178° C. in this example is determined(S15). If the sensed temperature T is 178° C., the data of signals from the copier is read (S16). And then if copying starts (S17), a copy is produced (S18), and the solenoid counter P is incremented by "+1" (S19) before the copying has finished(S20).

Figure 6:
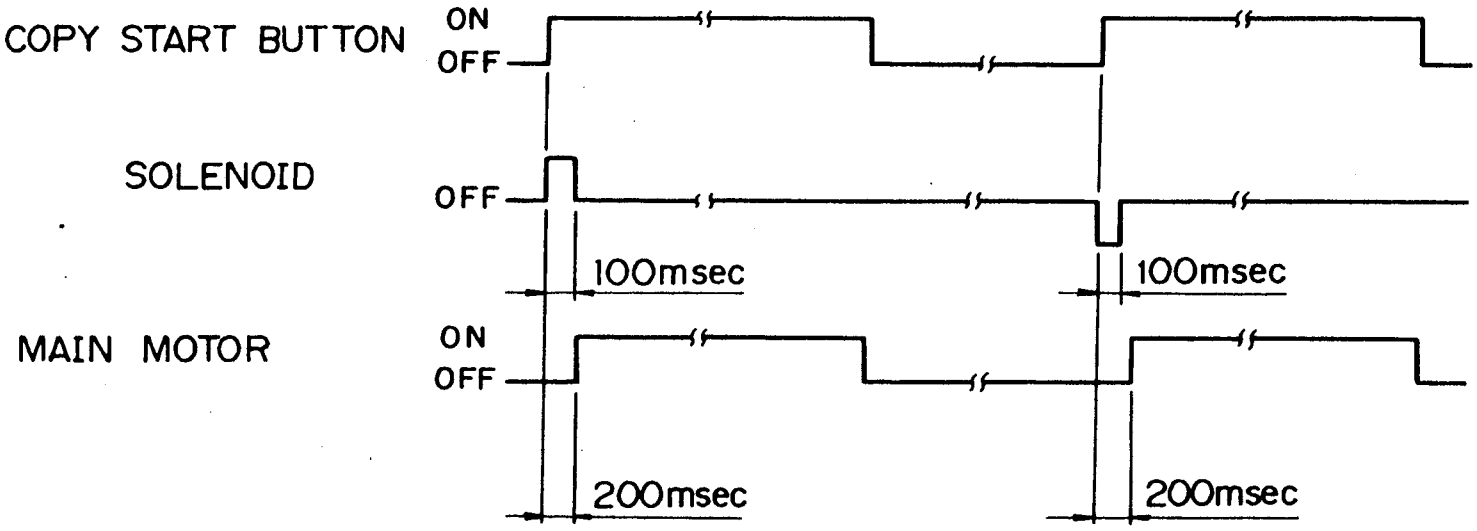
FIG. 6 is a timing chart according to still another embodiment of the present invention.
Figure 7:
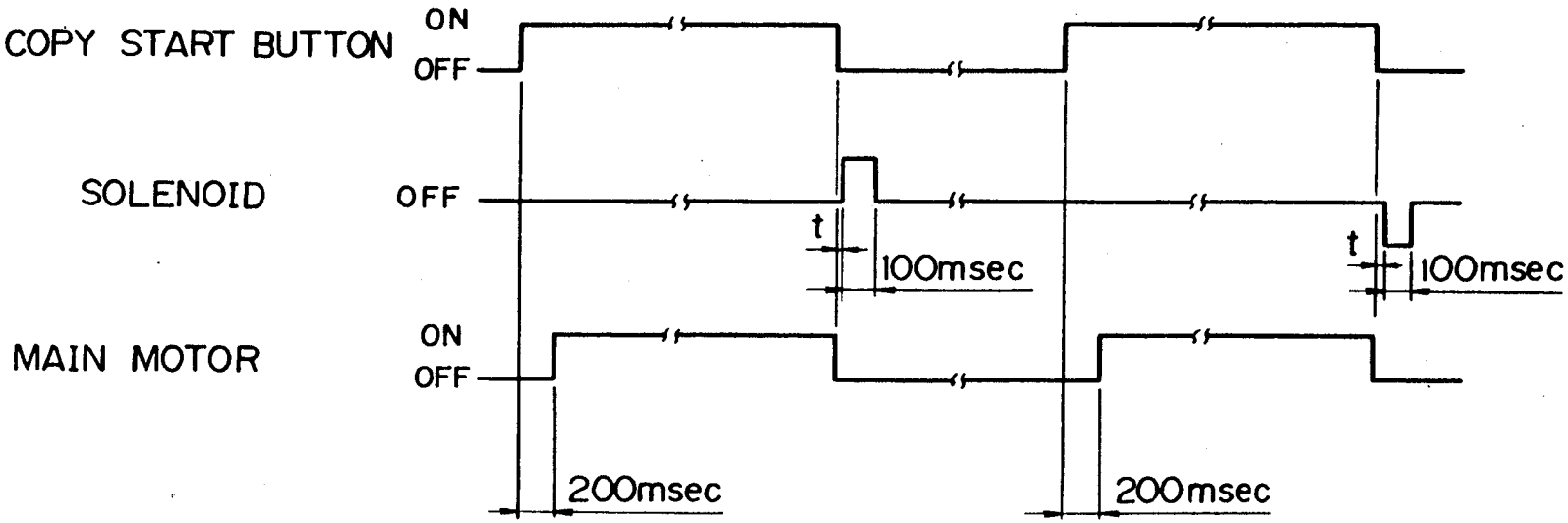
FIG. 7 is a timing chart according to still another embodiment of the present invention.
Figure 8:
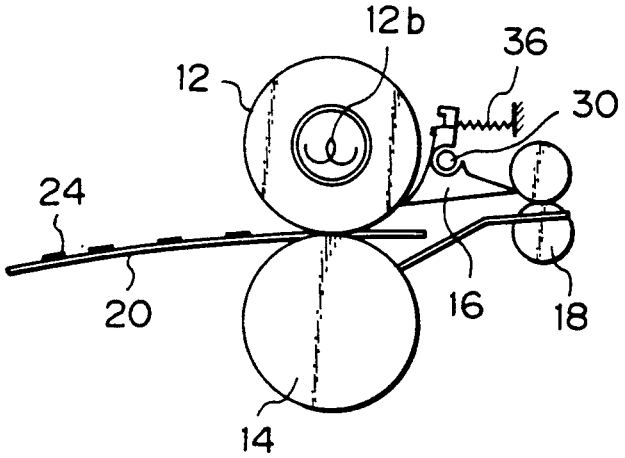
FIG. 8 is a sectional front view of a fixing apparatus embodying the prior art.

FIG. 6 and FIG. 7 show timing charts demonstrating examples of the said b) condition.

In the timing chart shown in FIG. 6, the bi-directional moving solenoid and the sheet separator pawls move just after the copy starting button has been turned on. The current to the bi-directional moving solenoid is set up for a short time which is 100 msec in this example, just when the copy starting button has been turned on during a warm-up period of the fixing roller 12. And the plunger 44*a* changes its position from the first position to the second position and stays at the second position even when the current to the solenoid is set off. After the copy starting button has been turned on and the predetermined time, for example 200 msec, has elapsed, a main motor to drive the fixing roller is controlled to be started. Therefore, the sheet separator pawls move only while the fixing roller does not rotate. After the copying operation is completed, it will become a warm-up period. And when the copy starting button has been turned on again, the current to the bi-directional moving solenoid is set up for a short time again. And the plunger 44*a* changes its position from the second position to the first position and stays at the first position even when the current to the solenoid is cut off. After the copy starting button has been turned on and the predetermined time, for example 200 msec, has elapsed, a main motor to drive the fixing roller is controlled to be started. Therefore, the sheet separator pawls move only while the fixing roller does not rotate, too.

In the timing chart shown in FIG. 7, the bi-directional moving solenoid and the sheet separator pawls move just after the fixing roller has stopped rotating. After the copy starting button has been turned on and the predetermined time, for example 200 msec, has elapsed, a main motor to drive the fixing roller is controlled to be started. And after the main motor has stopped rotating and the predetermined time t has elapsed, the current to the bi-directional moving solenoid is set up for a short time, which is 100 msec in this example. And the plunger 44*a* changes its position from the first position to the second position and stays at the second position even when the current to the solenoid is cut off. And afer the copy starting button has been turned on again and the predetermined time 200 msec has elapsed again, a main motor is controlled to be started. And then the current to the bi-directional moving solenoid is set up for a short time, and the plunger 40*a* changes its position from the second position to the first position and stays there. According to this embodiment, the pawls move and change their position whenever the copy starting button is turned on so that the flaws can be dispersed at two positions automatically and the life span of the fixing roller can be prolonged.

Further, in accordance with the present invention, the sheet separator pawls may be changed to more than two positions, for example, by using a ratchet wheel and a cam. When a count of the counter is over 5000 in the above a) condition or the copy starting button is turned on in the b) condition, a solenoid pulls the ratchet latch and the ratchet wheel becomes free from the latch and rotates at the predetermined angle. And as the cam is fixed on the shaft on which the wheel is fixed, the cam rotates at the same angle of the ratchet wheel together with the said wheel. And the cam makes the sheet separator pawls move at the same positions along the axis of the fixing roller.

Various modification will become possible for those skilled in the art after receiving the teaching of the present disclosure without departing from the scope thereof.

What is claimed is:

1. A fixing apparatus having sheet separator pawls for an image forming apparatus, comprising:

a pair of rollers engaged with each other and rotatable about respective axes for fusing and fixing toner images to a paper;

pivotable sheet separator pawl means having free ends resiliently engageable with the periphery of one of the said rollers for separating from the periphery of the roller a leading end portion of the paper with the fixed toner images, coming out of a nipping section of the rollers; and moving means for moving the sheet separator pawl means in parallel with the direction of the axes of said rollers only during a time when said rollers are stopped and in response to a signal indicative of an operational condition of the image forming apparatus, whereby the life of said rollers may be extended.

2. A fixing apparatus as claimed in claim 1, wherein the signal comprises a signal produced from electric switch means provided in the image forming apparatus.

3. A fixing apparatus as claimed in claim 2, in which the signal from said electric switch means comprises a signal produced from a main switch of the image forming apparatus.

4. A fixing apparatus as claimed in claim 2, in which the signal from said electric switch means comprises a signal produced from a copy starting switch of the image forming apparatus.

5. A fixing apparatus as claimed in claim 4, in which the sheet separator pawl means is moved by said moving means before the fixing roller means starts rotating.

6. A fixing apparatus as claimed in claim 4, in which the sheet separator pawl means is moved by said moving means after the fixing roller means stops rotating.

7. A fixing apparatus as claimed in claim 1, wherein the signal comprises a signal indicating that a surface temperature of the fixing roller means reaches the melting point of the toner.

8. A fixing apparatus as claimed in claim 1, wherein said moving means comprises a self-holding type solenoid having a permanent magnet.

9. A fixing apparatus having sheet separator pawls for an image forming apparatus, comprising:

a pair of fixing rollers engaged with each other and rotatable about respective axes for fusing and fixing toner images to a paper;

pivotable sheet separator pawl means having free ends resiliently engageable with the periphery of one of said fixing rollers for separating from the periphery of the roller a leading end portion of the paper with the fixed toner images, coming out of a nipping section of the fixing rollers; and moving means for moving the sheet separator pawl means in parallel with the direction of the axes of said rollers in response to a signal produced from a main switch of the image forming apparatus and after a surface temperature of said fixing rollers reaches the melting point of the toner.

* * * * *